United States Patent [19]

Rosendall

[11] 4,084,283

[45] Apr. 18, 1978

[54] FLOOR SWEEPER

[75] Inventor: Henry J. Rosendall, Grand Rapids, Mich.

[73] Assignee: Bissell, Inc., Grand Rapids, Mich.

[21] Appl. No.: 751,724

[22] Filed: Dec. 17, 1976

[51] Int. Cl.[2] ..... A47L 11/33

[52] U.S. Cl. ..... 15/48

[58] Field of Search ..... 15/41–48, 15/79 R

[56] References Cited

U.S. PATENT DOCUMENTS

| | | | |
|---|---|---|---|
| 3,457,575 | 7/1969 | Bienek | 15/41 R |
| 3,587,127 | 6/1971 | Rosendall | 15/48 |

*Primary Examiner*—Edward L. Roberts

*Attorney, Agent, or Firm*—Andrus, Sceales, Starke & Sawall

[57] ABSTRACT

A dust pan assembly is provided, with the assembly carrying at least one dust pan and the sweeper supporting wheels and axle means. The assembly is mounted beneath the sweeper housing with the ends of the axle means being disposed in horizontal slots adjacent the housing sidewalls. Movement of the sweeper in one direction causes the housing and slots to slide horizontally over the axle means and dust pan assembly until the rotary brush roll engages or disengages from the supporting and driving wheels on the assembly so that the brush roll drive is coupled or uncoupled. A brush cleaning comb is suspended from the dust pan assembly above the entrance to each pan. When a brush roll shifts relatively toward the assembly, the brush is carried into cleaning contact with the comb; while when the brush shifts relatively away from the assembly, it is carried out of contact with the comb.

18 Claims, 8 Drawing Figures

FLOOR SWEEPER

PRIOR ART OF INTEREST

U.S. Pat. No. 3,457,575; Bienek, July 29, 1969.
U.S. Pat. No. 3,587,127; Rosendall, June 28, 1971.

BACKGROUND OF THE INVENTION

This invention relates to a floor sweeper of the rotary brush type which can be used for sweeping both carpets and smooth floors.

Referring to both of the above-identified patents, it is already known to provide a floor sweeper with at least one rotatable brush and an adjacent dust pan, and wherein the brush rotates unidirectionally to continuously sweep dust and debris into the pan no matter whether the sweeper is being translated in a fore or aft direction over the floor. When the sweeper is translated in one direction, the brush is driven. When the sweeper is translated in the opposite direction, the brush freely rotates in the same direction as before. If pairs of brushes and dust pans are used, one brush is driven while the other brush freely rotates; and when the direction of sweeper translation is reversed, the formerly driven brush freely rotates and the formerly freely rotating brush is driven. In these patents, various types of brush coupling means are shown such as oppositely wound springs, a unidirectional clutch arrangement, and a bail operated lever system.

Referring to the above-identified U.S. Pat. No. 3,587,127, it is also known to provide brush cleaning combs pivotally mounted on the sweeper frame and which are swung by inertia to engage or disengage from the adjacent brush.

SUMMARY OF THE INVENTION

It is the task of the present invention to provide a simpler form of brush coupling means for a floor sweeper of the above type, which eliminates the need for springs,, unidirectional clutches, bail levers, etc. It is a further task to provide brush cleaning combs which do not have to pivot and yet which properly engage or disengage from the adjacent brush in response to sweeper movement.

In accordance with one aspect of the invention, a dust pan assembly is provided, with the assembly carrying at least one dust pan and the sweeper supporting wheels and axle means. The assembly is mounted beneath the sweeper housing with the ends of the axle means being disposed in horizontal slots adjacent the housing sidewalls. Movement of the sweeper in one direction causes the housing and slots to slide horizontally over the axle means and dust pan assembly until the rotary brush roll engages or disengages from the supporting and driving wheels on the assembly so that the brush roll drive is coupled or uncoupled. When a pair of dust pans and brush rolls are used, relative shifting in one direction between the housing and brush rolls couples one brush roll and uncouples the other. When the relative shifting is in the opposite direction due to a reversal of sweeper movement, the previously coupled brush roll is uncoupled and the previously uncoupled roll is coupled.

In accordance with another aspect of the invention, a brush cleaning comb is suspended from the dust pan assembly above the entrance to each pan. When a brush roll shifts relatively toward the assembly, the brush is carried into cleaning contact with the comb; while when the brush shifts relatively away from the assembly, it is carried out of contact with the comb. Thus, when the brush is coupled or uncoupled, it automatically engages or disengages the comb.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figure 1:
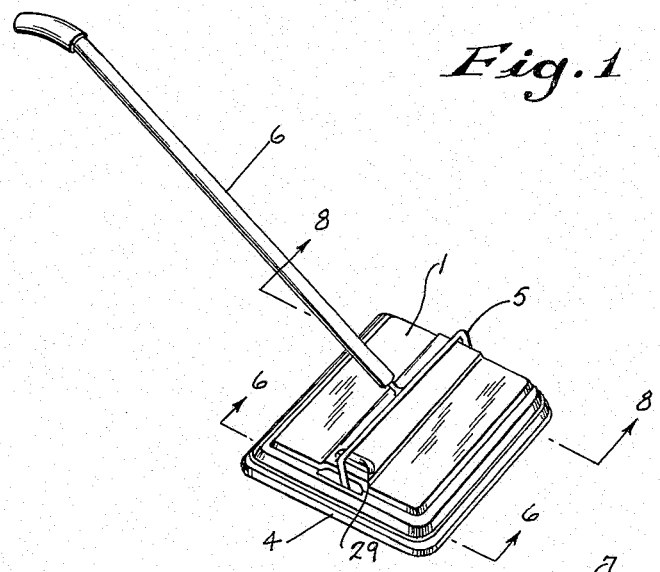
FIG. 1 is a perspective view of a floor sweeper constructed in accordance with the invention.

Although the inventive concept may be usable in a floor sweeper having only a single unidirectional alternately driven and freely rotating brush, the embodiment shown herein utilizes a pair of spaced brushes.

As shown in the drawings, the invention is embodied in a floor sweeper having a frame or housing which includes a top wall 1, side walls 2 and end walls 3. If desired, a rubber bumper 4 may encompass walls 2 and 3 to protect furniture. A suitable bail 5 is mounted to the sweeper and has the usual handle 6 extending upwardly therefrom.

Figure 2:
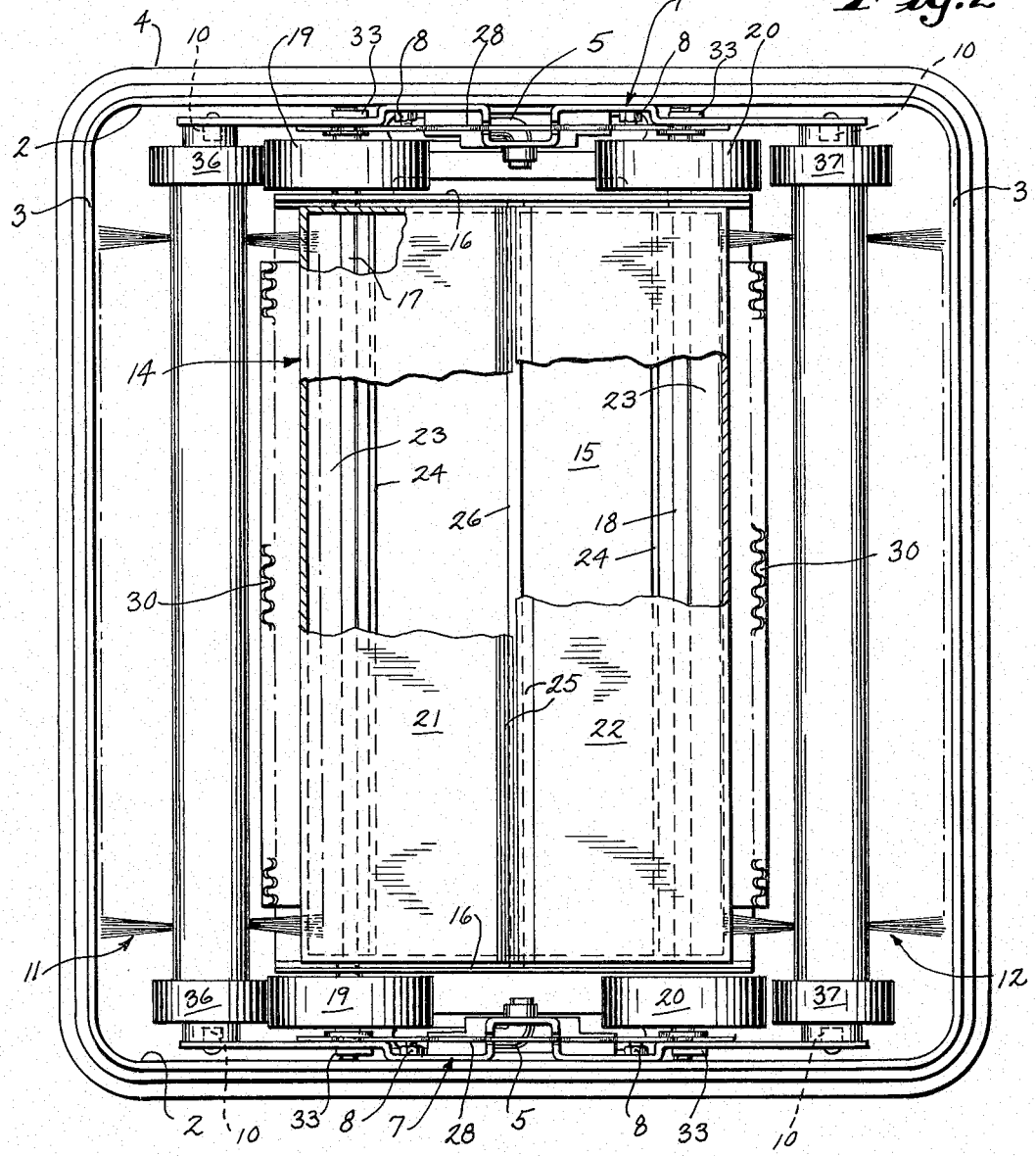
FIG. 2 is a bottom plan view of the sweeper, with parts broken away.
Figure 3:
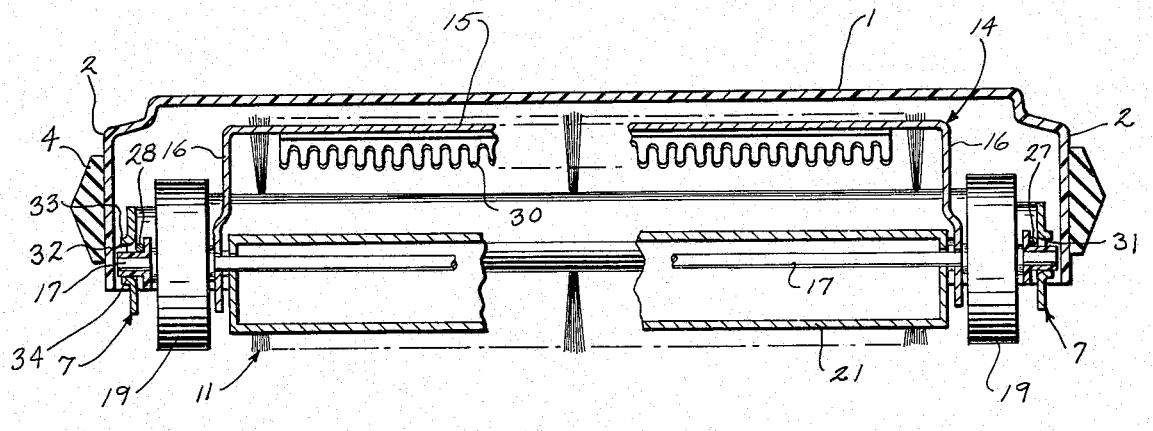
FIG. 3 is a transverse section taken on line 3—3 of FIG. 6.
Figure 4:
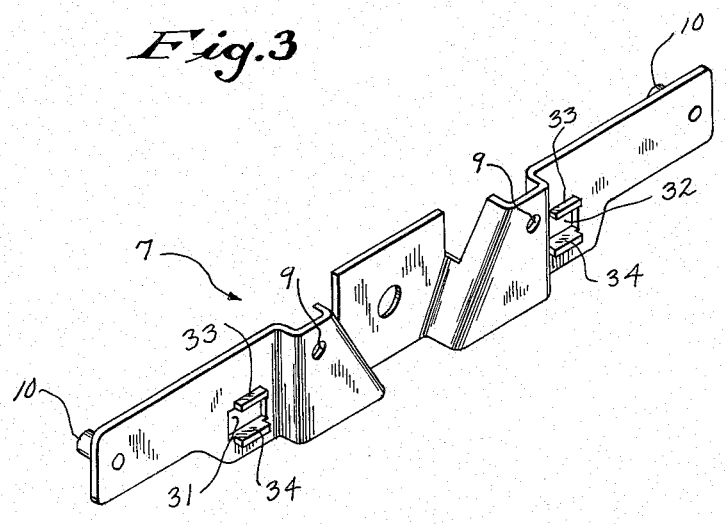
FIG. 4 is a perspective view of a mounting bracket.

Referring particularly to FIGS. 2 and 4, a mounting bracket 7 is fixedly secured to each side wall 2, as by bolts 8 extending through bracket openings 9 and the side wall. The center of each bracket 7 receives the end of bail 5. Each end of each bracket 7 is provided with an inwardly extending stub axle 10, with transversely opposed axles receiving the end portions of an elongated sweeper brush 11, 12, the pair of brushes being longitudinally spaced. Brushes 11, 12 are adapted to freely rotate about axes fixed with respect to the sweeper housing.

Figure 5:
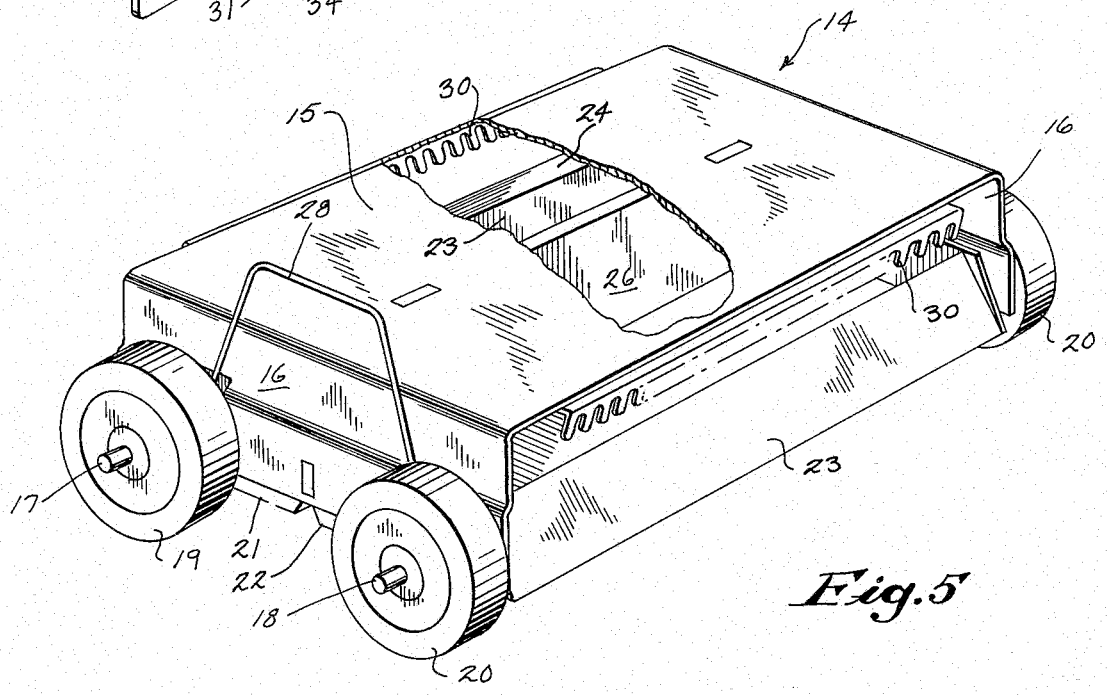
FIG. 5 is a perspective view of a dust pan assembly.

The brushes are adapted to sweep dust and debris from the surface of a floor 13 into suitable receptacles. For this purpose, a unitary dust pan assembly 14 is provided. Referring to FIG. 5, etc., assembly 14 comprises a channel-like member having a top wall 15 and downwardly extending end flanges 16. A pair of transverse axles 17, 18 extend between and through the lower forward and rear portions of flanges 16. The outer end portions of axles 17, 18 extend beyond the flange walls and mount two pairs of freely rotatable sweeper support and drive wheels 19, 20 respectively.

A pair of transverse dust pans 21, 22 are pivotally mounted to the respective axles 17, 18 inside of flanges 16. The pans are provided with a closed floor but are open at their tops and along their outer sides. An inclined lip 23 on the open side of each respective pan terminates adjacent the axle in a toothed fluff trap 24 to prevent debris from escaping the pans. The inner edge of each pan terminates in a lip 25 which closingly engages with an elongated transverse brace 26 which extends between flanges 16 and separates the assembly into two pan portions.

Pans 21 and 22 are held in normally closed position by a plurality of generally inverted U-shaped springs 27, 28 which are attached to the pan ends and extend between adjacent pans. Spring 28 is adapted to extend upwardly through the housing top wall 1 and provides a top handle portion 29 which, when pressed downwardly, causes the dust pans to be forced open for emptying.

The transverse front and rear edges of assembly top wall 15 are provided with elongated downwardly extending brush cleaning combs 30 which are fixed to the wall.

The dust pan assembly is mounted between brushes 11 and 12 in a manner so that there may be relative horizontal longitudinal movement therebetween. For this purpose, axles 17 and 18 extend outwardly beyond wheels 19 and 20 and are received within longitudinally extending elongated slots 31, 32 disposed in brackets 7 and which are thus fixed relative to the sweeper housing. The slots may be formed by outward striking of the bracket material, thus providing upper ears 33 and lower axle supporting ledges 34 to reduce wear.

Brushes 11 and 12 are so constructed and controlled so that they continuously rotate in one direction only and thus sweep dirt and the like into their respective pans at all times, regardless of the direction or change of direction of reciprocal translation of the sweeper over a floor surface.

For the above purpose, each brush is adapted to rotate freely in one direction so that contact of the brush with floor 13 during translation will cause the brush to sweep into its respective pan. The direction of permissible free rotation for one brush is, however, opposite to the direction of free rotation for the other brush. Thus, brush 11 will rotate freely in counterclockwise direction during leftward sweeper translation, and brush 12 will rotate freely in a clockwise direction during rightward sweeper translation.

However, when one brush is rotating freely, the other brush is blocked from such free rotation and is actually positively driven by the sweeper mechanism in a direction opposite to that of the freely rotating brush. Upon reversal of the direction of sweeper translation, the free or driven actions of the brushes reverse.

The brushes are selectively driven through a coupling mechanism which includes sweeper drive wheels 19 and 20, and coupling wheels 36, 37 which are disposed on the end portions of respective brushes 11 and 12. All of these wheels preferably have rubber-like frictional surfaces thereon.

In accordance with one aspect of the invention, and in the embodiment shown in the drawings, horizontal relative movement in one direction between the sweeper housing and the dust pan assembly causes coupling of one brush to the respective drive wheel 19 or 20 while the other brush is uncoupled. Horizontal relative movement in the opposite direction reverses the coupling action.

Figure 6:
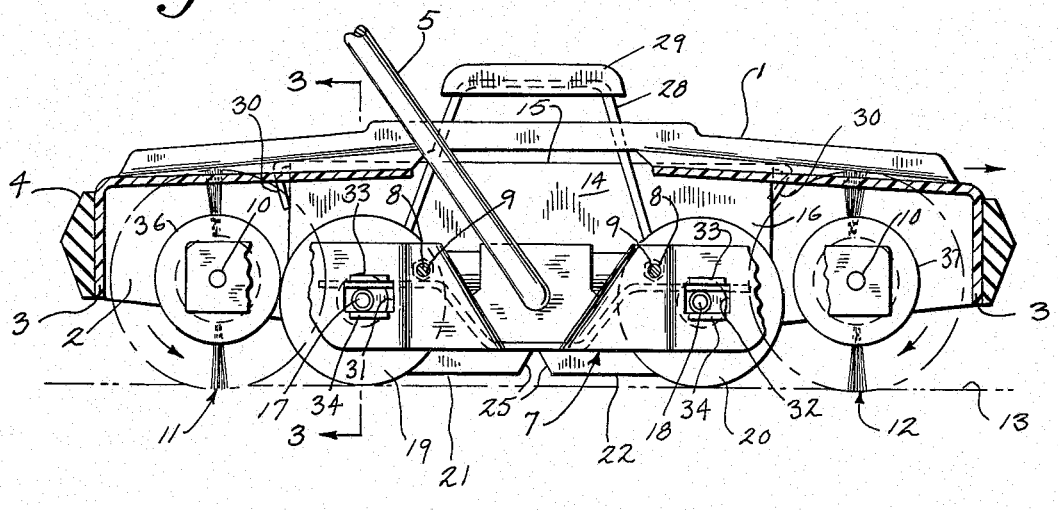
FIG. 6 is a longitudinal section of the sweeper taken on line 6—6 of FIG. 1 with parts broken away and showing the action when the sweeper is moved in one direction, i.e. forwardly.

As best shown in FIG. 6, when the sweeper is moved forwardly or to the right, the friction forces between sweeper wheels 19, 20 and floor 13 is greater than the friction forces between axles 17, 18 and slots 31, 32. Therefore, the sweeper housing slots ride rightwardly over the respective axles and carry rear coupling wheels 36 into mutual engagement with rear sweeper wheels 19 as shown. A lost motion action is thus created. At the same time, front coupling wheels 37 are carried forwardly out of mutual engagement with front sweeper wheels 20. As soon as wheels 36 engage wheel 19, relative shifting between the sweeper housing and dust pan assembly is stopped and the entire sweeper moves forwardly as a unit. Rear brush roll 11 is driven by wheels 19 to sweep dust and debris into pan 21, while front brush roll 12 freely rotates to sweep into pan 22.

Figure 7:
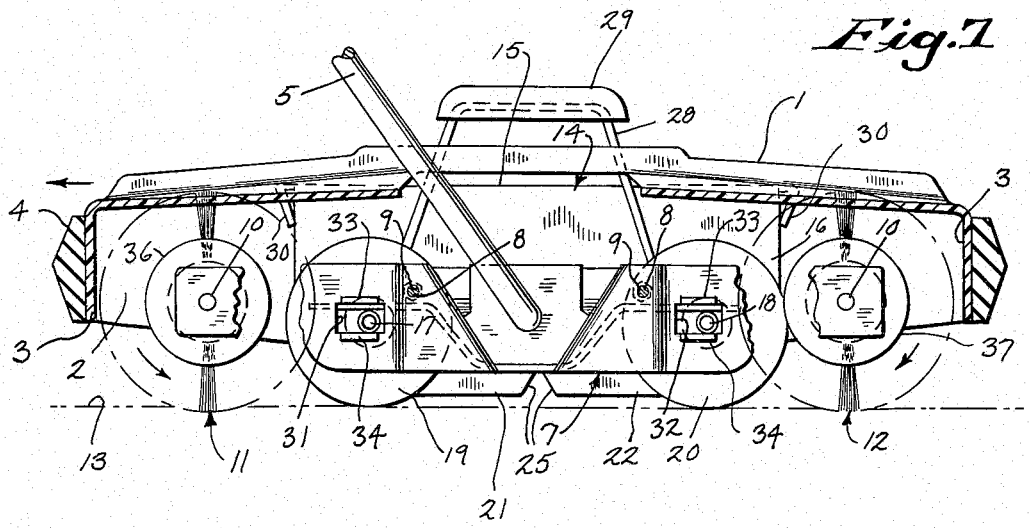
FIG. 7 is a view similar to FIG. 6 and showing the action when the sweeper is moved in the opposite direction, i.e. rearwardly.
Figure 8:
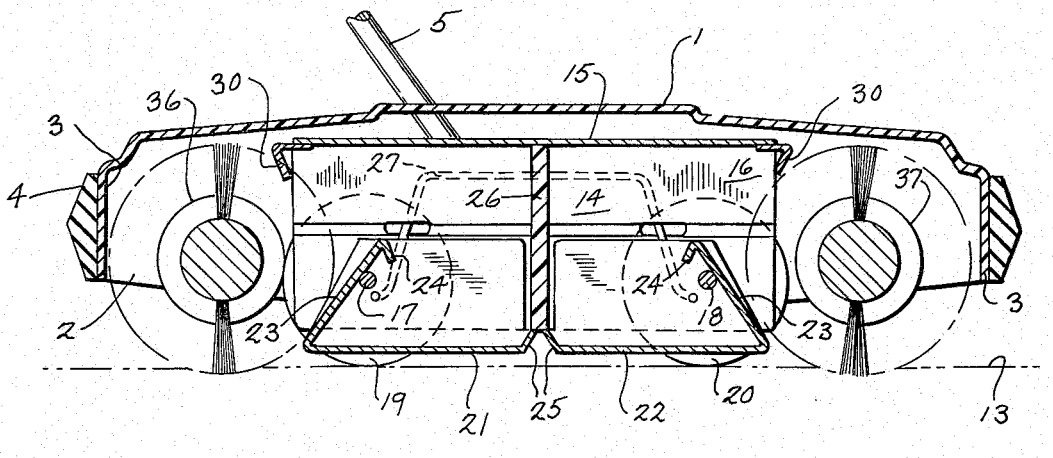
FIG. 8 is a longitudinal section taken on line 8—8 of FIG. 1.

As best shown in FIG. 7, when the sweeper is moved rearwardly or to the left, the relative difference in friction forces causes the sweeper housing slots to ride leftwardly over the respective axles and carry front coupling wheels 37 into mutual engagement with front sweeper wheels 20, as shown. At the same time, rear coupling wheels 36 are carried rearwardly out of mutual engagement with rear sweeper wheels 19. As soon as wheels 37 engage wheels 20, relative shifting between the sweeper housing and dust pan assembly is stopped and the entire sweeper moves rearwardly as a unit. Rear brush roll 11 now freely rotates and front brush roll 12 is driven by wheels 20, with both brush rolls still rotating in the same direction as previously.

In accordance with another aspect of the invention, and in the embodiment shown in the drawings, horizontal movement in one direction between the sweeper housing and dust pan assembly causes one brush to be carried into overlapping relationship with its adjacent comb, while the other brush is carried away from cleaning engagement with its adjacent comb.

As also shown in FIG. 6, when the sweeper is moved forwardly or to the right, rear brush roll 11 is carried into overlapping engagement with rear comb 30, while front brush roll 12 is carried away from front comb 30. When wheels 36 engage wheels 19, the amount of penetration or separation of the brushes from the combs stop increasing and as the sweeper moves forward as a unit, rear brush 11 is cleaned by its adjacent comb 30 and front brush 12 is free of its adjacent comb.

As also shown in FIG. 7, when translative motion of the sweeper is reversed, front brush roll 12 is carried into overlapping engagement with front comb 30, while rear brush roll 11 is carried away from rear comb 30. When wheels 37 engage wheels 20, the amount of penetration or separation of the brushes from the combs stop increasing and as the sweeper moves rearwardly as a unit, front brush 12 is cleaned by its adjacent comb 30 and rear brush 11 is free of its adjacent comb.

Thus, a combined effect is produced. When a brush coupling wheel is caused to engage its drive wheel to drivingly rotate the brush, the adjacent comb is automatically engaged by the driven brush. When the brush coupling wheel is caused to separate from its drive wheel so that the brush freely rotates, the latter automatically disengages from its adjacent comb so that the comb does not interfere with the free rotation of the brush on the floor.

The concept of the invention provides a technical advance wherein a shiftable dust pan assembly which carries the sweeper drive wheels and the brush cleaning combs cooperates with the sweeper housing to provide selective drive of unidirectional brushes and simultaneous cleaning of the driven brush in both directions of translation of the sweeper over the floor.

Various modes of carrying out the invention are contemplated as being within the scope of the following claims particularly pointing out and distinctly claiming the subject matter which is regarded as the invention.

I claim:

1. In a floor sweeper:
a. a housing,
b. a brush mounted on a fixed axis within said housing for delivering dust to a dust-receiving area upon reciprocal translation of the sweeper over a floor,
c. said brush being disposed to contact and freely rotate on the floor in a direction to deliver dust to the dust-receiving area upon translation of the sweeper in one direction,
d. a coupling wheel on said brush,
e. and means to positively drive said brush through said coupling wheel and in the same direction as its aforementioned free rotation upon translation of the sweeper in the opposite direction, said drive means comprising:
1. a unitary assembly disposed within said housing adjacent said brush and with said assembly including a sweeper supporting wheel and a dust pan defining said dust-receiving area,
2. and means mounting said assembly and housing for relative horizontal longitudinal movement therebetween so that translation of said sweeper in one direction causes said relative movement to thereby mutually engage said first and second-named wheels to drive said brush, and so that translation of said sweeper in the opposite direction causes said relative movement to thereby mutually disengage said first and second-named wheels to release said brush from the drive.

2. The floor sweeper of claim 1 wherein translation of said sweeper in either direction causes said housing to move relative to said assembly so that said coupling wheel engages or disengages from said sweeper supporting wheel.

3. The floor sweeper of claim 1 in which said mounting means comprises lost motion means between said assembly and said housing.

4. The floor sweeper of claim 1 in which said mounting means comprises:
a. axle means mounting said sweeper supporting wheel to said assembly and with said axle means extending outwardly from said last-named wheel,
b. and elongated longitudinally extending slot means fixed relative to said housing and receiving the outwardly extended axle means.

5. The floor sweeper of claim 4 wherein translation of said sweeper in either direction causes said housing and slot means to ride over said axle means so that said coupling wheel engages or disengages from said sweeper supporting wheel.

6. The floor sweeper of claim 5 wherein upon engagement of both said wheels said assembly and said housing move over the floor as a unit.

7. The floor sweeper of claim 5:
a. wherein a pair of rotary brushes are provided and with each said brush having a said coupling wheel thereon,
b. said assembly being disposed between said brushes and having a said sweeper supporting wheel disposed adjacent each said coupling wheel,
c. translation of said sweeper in one direction causing said housing and slot means to ride over said axle means so that one of said coupling wheels disengages from one of said sweeper supporting wheels, and the other of said coupling wheels engages the other of said sweeper supporting wheels so that said assembly and said housing move in said one direction as a unit,
d. translation of said sweeper in the opposite direction causing said housing and slot means to ride over said axle means so that the said other of said coupling wheels disengages from the said other of said sweeper supporting wheels, and the said one of said coupling wheels engages the said one of said sweeper supporting wheels so that said assembly and said housing move in said opposite direction as a unit.

8. In the floor sweeper of claim 7:
a. a pair of downwardly extending brush cleaning combs disposed on said assembly and adjacent each said brush,
b. each said comb being adapted for alternate positioning into or out of cleaning engagement with its respective adjacent brush upon reciprocating translation of said sweeper over the floor.

9. The floor sweeper of claim 8 wherein:
a. each said comb is disposed in overlapping engagement with its adjacent brush when the latter is driven,
b. and each said comb is disposed out of cleaning engagement with its adjacent brush when the latter is released from the drive.

10. In the floor sweeper of claim 1:
a. a downwardly extending brush cleaning comb disposed on said assembly above said dust pan,
b. said comb being adapted for positioning into or out of cleaning engagement with said brush upon relative movement between said assembly and said housing.

11. The floor sweeper of claim 10 wherein said comb overlappingly engages said brush when the latter is driven, and is out of cleaning engagement with said brush when the latter is released from the drive.

12. In a floor sweeper:
a. a housing,
b. a rotatable brush disposed within said housing for delivering dust to a dust receiving area upon reciprocal translation of the sweeper over a floor,
c. means in said housing to rotate said brush,
d. a dust pan assembly disposed within said housing and defining said dust receiving area and with said assembly and housing being relatively movable horizontally,
e. and a downwardly extending brush cleaning comb disposed on said assembly,
f. said comb being adapted for positioning into and out of cleaning engagement with said brush upon relative movement between said housing and said assembly.

13. In a floor sweeper:
a. a housing,
b. a rotatable brush disposed within said housing for delivering dust to a dust receiving area upon reciprocal translation of the sweeper over a floor,
c. a dust pan assembly disposed within said housing and defining said dust receiving area,
d. mutually engageable coupling wheels on said brush and said assembly to rotate said brush,
e. and means mounting said housing and assembly for relative longitudinal horizontal movement therebetween so that translation of said sweeper over the floor causes said relative movement and a resultant engagement or disengagement between said coupling wheels.

14. The floor sweeper of claim 13 in which said mounting means comprises lost motion means between said assembly and said housing.

15. The floor sweeper of claim 13 in which said mounting means comprises:

a. axle means mounting said assembly coupling wheel to said assembly and with said axle means extending outwardly from said assembly coupling wheel, d. and elongated longitudinally extending slot means fixed relative to said housing and receiving the outwardly extending axle means.

16. The floor sweeper of claim 15 wherein translation of said sweeper in either direction causes said housing and slot means to ride over said axle means until engagement of said mutually engageable coupling wheels occurs.

17. In the floor sweeper of claim 16:

a. a downwardly extending brush cleaning comb disposed on said assembly, b. said comb being adapted for positioning into and out of cleaning engagement with said brush upon relative movement between said housing and said assembly.

18. The floor sweeper of claim 17 wherein said comb overlappingly engages said brush upon engagement of said mutually engageable coupling wheels, and is out of cleaning engagement with said brush when said mutually engageable coupling wheels are disengaged.

* * * * *